US005890604A

United States Patent [19]

Heinz

[11] Patent Number: 5,890,604

[45] **Date of Patent: *Apr. 6, 1999**

[54] THIN SNAP SUPPORT TABS FOR HANG STORAGE OF POSTERS AND CHARTS AND A TOOL FOR ATTACHING SUCH TABS TO SAID POSTERS AND CHARTS

[76] Inventor: Ted Heinz, 33694 Colgate Dr., Union City, Calif. 94587

[ * ] Notice: This patent issued on a continued prosecution application filed under 37 CFR 1.53(d), and is subject to the twenty year patent term provisions of 35 U.S.C. 154(a)(2).

[21] Appl. No.: 724,011

[22] Filed: Sep. 30, 1996

[51] Int. Cl.[6] ..... A47F 7/16; A47B 63/00

[52] U.S. Cl. ..... 211/46; 312/184

[58] Field of Search ..... 211/46, 94.02; 312/183, 184; 40/401, 404, 395, 617

[56] References Cited

U.S. PATENT DOCUMENTS

| | | | |
|---|---|---|---|
| 249,849 | 11/1881 | McGill | 312/184 |
| 1,066,543 | 7/1913 | Stillwell | 312/184 |
| 1,687,859 | 10/1928 | Fontaine | 312/184 |
| 1,993,505 | 3/1935 | Engel | 40/401 X |
| 2,165,157 | 7/1939 | Smith | 312/184 |
| 2,605,769 | 8/1952 | Lampel | 211/46 |
| 3,923,353 | 12/1975 | Elias et al. | 211/46 X |
| 4,009,784 | 3/1977 | Elias et al. | 211/46 |
| 4,674,637 | 6/1987 | Lovelock et al. | 211/46 |

FOREIGN PATENT DOCUMENTS

| | | | |
|---|---|---|---|
| 842937 | 7/1952 | Germany | 312/184 |

*Primary Examiner*—Peter M. Cuomo
*Assistant Examiner*—James O. Hansen
*Attorney, Agent, or Firm*—Paul F. Schneck

[57] ABSTRACT

A tab/hook like device for hanging posters and charts (or other large graphics) for storage, retrieval and reorganization. One or more flat flexible plastic tabs with holes and slits, acting as easily opened and automatically closing tabs, are attached to the back top edge of the posters or charts to be stored. If multiple tabs are used, then the tabs are separated at a preestablished intervals along the top edge of the poster or chart. (Alternatively one long tab may be used spanning the same distance at the top of the poster or chart.) These tab/hooks holding a poster or chart are snapped onto the rods or rings of a holding rack. Because the posters and charts are hanging they are easy to separate, review and locate; and because the tab/hooks are flexible, individual posters or charts may easily be removed from the rack and placed back again on the rack in any other position within the established sequence of posters or charts. (A variation of this invention for didactic flip charts uses a somewhat more heavy duty flat plastic hook.)

10 Claims, 8 Drawing Sheets

16
13
18b
12
17b
14b
11b
18a
17a
11a
14a
15a
15

THIN SNAP SUPPORT TABS FOR HANG STORAGE OF POSTERS AND CHARTS AND A TOOL FOR ATTACHING SUCH TABS TO SAID POSTERS AND CHARTS

BACKGROUND OF THE INVENTION

The present invention relates to systems for storage of graphics, charts, maps, posters and similar objects, which are referenced in the following as posters or charts, in the claims refered to as "sheetlike objects", without restricting the objects which can be stored using the present invention to the same. It is particularly applicable for posters and charts ranging from 15" to 30" in width and from less than 10" to more than 40". in height. This invention is of particular importance for use in classrooms where many different didactic and decorative posters and charts are displayed and used as part of an ongoing curriculum. Because they are periodically changed to support the progression of the learning process it is important to have an efficient and easy system for handling and storing these relatively large graphics. This invention provides a new type of tab/hook device for hanging posters and charts or the like in a simple and flexibly fashion and allows to establish an order to organize easy storage and retrieval. Furthermore, a tool is disclosed for attaching tabs/hooks to a poster, chart or the like. In the following disclosure of the present invention the tab/hook device is referenced as a tab without diminishing its feature as a hook for hanging an object on a rack.

DISCUSSION OF PRIOR ART

There are existent various methods for dealing with storage and retrieval of posters and charts. It is usually believed best to store posters laying flat on large flat sleeves. But such flat files generally take too much horizontal space (especially in classrooms where space is at a premium) and are not very handy for reorganizing and locating particular filed objects. Sometimes very large envelopes or cardboard folders are used. However, placing and removing posters and charts from such envelops is time consuming; and storage of these containers is still a problem. Often the tops of cabinets are used for storing such objects; but climbing up on a chair to get a stored item from somewhere in the stack of stored items is a dangerous hassle. Another space consuming arrangement is a large V shaped box which allows posters with cardboard dividers to lie inclined while permitting easy review and retrieval.

Often posters and charts are rolled up. Storage of these rolls can become at best haphazard; and it is difficult to handle the posters or charts after they are opened up because they tend to roll back up. At times one is tempted to mount the posters; but this is expensive and bulky solution. Another popular way to hang a poster without mounting is using two ribs, one at the top another at the bottom. A long triangular extrusion clamps onto the top of the poster with the other along the bottom. A string is threaded through the opening of the top rib in order to hang it. This is handy because it can be handled easily. It can be rolled up easily and unrolled. It hangs straight because of the weight of the bottom rib. However, these ribs are not altogether inexpensive. And, unlike the present invention, they are bulky, not allowing compact storage when handling a large number of posters. As can be appreciated, expense, the use of valuable space, and the lack of easy handling present problems for teachers who want to use these valuable didactic and motivational tools.

Didactic flip charts present less of a storage problem in the classroom. Flip chart racks holding a series and sequence of charts to be presented to students are common in classrooms. Charts with holes punched in the top are threaded on rings allowing the charts to hang and be flipped over to the back as each is used in teaching a lesson. Although most chart racks can hold quite a large number of charts not in use without taking up significant space, they still present a problem when it comes to reorganizing. The main problem being that charts must be threaded onto the rings in a set sequence. If the sequence is to be changed the charts have to be removed, rearranged and then rethreaded.

The following patent has some relationship to the present invention: U.S. Pat. No. 4,403,883 is a suspension filing system. Other products which some remote similarities to the thin snap-on tab of the present invention:

- plastic labels which easily slip and snap into place on the stem of a nursery plants;
- cardboard tags which slip onto the review mirror support of automobiles, e.g. at the automobile repair shop.
- plastic ruler/page marker that snaps on and off the rings of the DAY RUNNER PERSONAL ORGANIZER™ notebook;
- the cards on a ROLODEX™ rotary file;
- certain flat plastic tab/hooks used to hold items for sale on display supports.

OBJECTIVES OF THE INVENTION

It is an object of the present invention is to provide for a convenient and economical system for storage and retrieval of posters, charts and the like.

It is another object of the invention to provide for space saving hooks for hanging flat objects such as posters, charts and the like on a hanging rack.

It is another object of the invention to provide for method and means to attach hanging hooks to flat objects such as posters, charts and the like.

DESCRIPTION OF THE INVENTION

In the present invention one or more flat bendable plastic tabs, acting as hooks, which easily open and automatically close, are attached to the top edge of the posters or charts. These tabs are spaced at a preestablished intervals and preferably centered and symmetrical on the top edge of the poster or chart. (Alternatively one long tab, including one or more hooks, may be used spanning the same distance at the top of the poster or chart.) In order to hang a poster or chart, these tabs are snapped onto the rods or rings of a holding rack. Because the posters and charts are hanging they are easy to separate and review for retrieval of a particular one. And because the tabs are flexible, individual posters or charts may easily be removed and placed in any other position within the established sequence of posters or charts. As an organizing aid, dividers may be introduced like in a file, and the tabs can be provided in various distinguishing colors. This works especially well if viewed from the top. The hanging posters or charts, separated by the categories established by the dividers, can be slid and separated on the rack so as to see and confirm the category and location of any particular posters or charts desired.

In many classrooms a variety of didactic and decorative posters and charts are displayed and used as part of an ongoing curriculum and periodically must be changed to support the progression of the learning process. Because of many demands in the schools, space, time, and economy are of utmost importance. This invention provide for a means for hanging posters and charts simply and flexibly in a way that permits a teacher to easily organize (and reorganize) for storage and retrieval. Individual posters or charts may be quickly removed or returned to any position within the sequence of hanging posters or charts. The tab is generally very close to the same thickness as most charts and posters; thus, very little space is needed. The difference being that: stacked they use considerable valuable horizontal space, whereas hanging they do not; rather, a manageable vertical slice. This compact set of hanging posters or charts can be placed against the wall or within the parameters of a chart rack. The tab do not distract from the normal use of the posters when put on display.

In the preferred embodiment the tabs are transparent or are attached to the poster or chart using transparent tape and if used to support the posters when they are hanging, do not distract from it because you can't see them. Push tacks can be left on the walls and posters easily changed, putting the new one in exactly the same place without the hassle of untacking and retacking. Or, alternatively, because they are very thin, they may be left back behind the poster when it is hung on the wall. If viewed from the top a set of hanging posters or charts can be used much like a file cabinet. Dividers may be introduced as part of a specifically established filing system. The hanging posters or charts, separated by the categories identified by the dividers or the color of the tabs, can be slid and separated on the rack so as to see and confirm the location of any particular one(s) desired. Besides being of great use in classrooms this invention has applications in many other settings, such as:

stores specializing in posters, prints, maps, etc.;

libraries, likewise for posters, prints, maps, etc.;

offices and businesses dealing with graphics such as architects and graphic designers.

Some variations of this invention are:

besides two separate tabs, long tabs might also be used. A long tab along the entire top edge would provide added support for very thin or flimsy sheets as well as heavy charts and maps. (However, with most posters and charts it was discovered to be unnecessary.)

Holes can be spaced and located identically as in the two precisely located individual tabs. Such items would fit on the same double rod rack.

A long tab at the bottom could add some weight and rigidity to make a poster hang straighter.

A long tab with one hole at the center could support a chart or poster as if there were two tabs of the long tab is at least as long as two tabs are spaced apart and provide even more ease for handling. Depending on the setting, this would have some advantage. A one rod rack would be used. It would be somewhat simpler to handle in viewing, placing and removing from the rack or display tacks on the wall. The disadvantage is the greater cost because more plastic is used.

Easy release adhesive tape could be used, especially on the single long tab. This would be particularly useful in a store that sells prints. Once a customer has bought a poster it could be removed from the single long tab which could be then reused for another poster.

Double long tabs might be used on each side of the open end of large rectangular plastic bags. In the classroom this would be useful to hold bulletin board materials. The double long tabs would be placed along the top edges of opposite sides of the bag.

Large folders could be hung in which any number of large flat materials are filed, such as bulletin board materials, student artwork, etc.

The basic element of this invention is the flexible tab attached to the top edge of a poster or chart. However, this requires some kind of a rack consisting of one or more protruding rods or knobs on which the tabs snap to support the hanging poster or chart. Many different types of racks can be used, even as simple as one or more nails or push tags spaced properly apart in a wall. The tab consists of a thin plastic (in the preferred embodiment Mylar™ plastic 0.010" thick for posters and individual display charts, and 1/32" polycarbinate plastic for flip charts). Tabs have one centrally located hole, or a plurality of symmetrically arranged holes, each hole being large enough to accommodate, with some extra space, the diameter of the rod on which it is to hang. The tab is split, from the top or side in a straight or curved line, to the hole. This allows the rod to pass along the slit (which flexes open) and into the hole. The tab then snaps back to its original position enclosing and holding onto the rod. There are three types of tabs:

1) individual (used in pairs);

2) long (for single rod or to provide added support); and 3) heavy duty with elongated slot shaped hole (for flip charts).

Within each of these types a variety of shapes are possible:

more rounded than square;

with bulge around hole of long tab/hook and thinner in rest of extension; etc.

The shapes of the tabs do not effect the basic principles of this invention: thin tabs/hooks which allow the insertion of a rod by way of a flexible slit (or wider opening) into an area which is closed over the rod and rigid enough to support the weight of the poster or chart. The tabs in the preferred embodiment are transparent. However, for classifying the attached chart or poster, colored tabs can be used. Tabs are attached with adhesive tape (transparent in the preferred embodiment) in such a way that the tab but-up against the top edge of the poster or chart and an adhesive bridges from a tab surface to the surface of the attached chart or poster. In the preferred embodiment the tab has an area for receiving the adhesive tape and an area in which the opening and the slit is located. However the adhesive tape may be attached to the whole tab if provisions are made to cut out the hanging opening and the slit. In another version the tab may have a recessed area with an adhesive material which can be attached directly to a chart or poster. However, such a design requires a thicker tab, which lowers the efficiency of the hanging storage. For high efficiency storage the thickness of a tab is generally very close to the thickness of the charts and posters and it should not exceed double the thickness of a chart or poster attached to it. This allows the posters and charts to be bunched together and to occupy practically no more volume than if the posters and charts were stacked flat without the tab/hooks. At a thickness of no more than 1/64" fifty to sixty posters hang easily within each inch of rod space.

Various aids for correct positioning and mounting are possible. It is important to have guides which determine the exact distance (14" in the preferred embodiment) between the tabs, as well as for centering the tabs along the top edge of the poster or chart. Also, precut clear adhesive tape on release paper may be provided; or, clear adhesive tape may be integrated into the product during manufacture with release paper to be removed just before attaching the tab/hook in the correct position.

SHORT DESCRIPTION OF THE DRAWINGS

FIGS. 8*a* through 8*e* are illustrations of tabs with alternative types of slits.

Figure 9A:
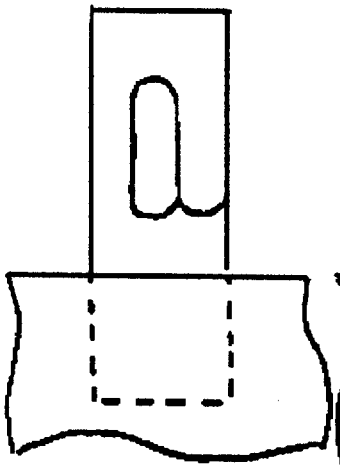
Figure 9B:
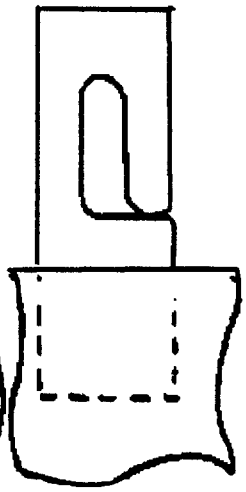
Figure 9C:
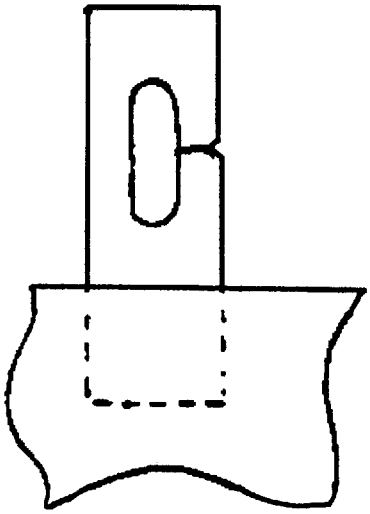

FIGS. 9*a* through 9*c* are illustrations of tabs with elongated openings and alternative slits for use with flip charts.

Figure 10:
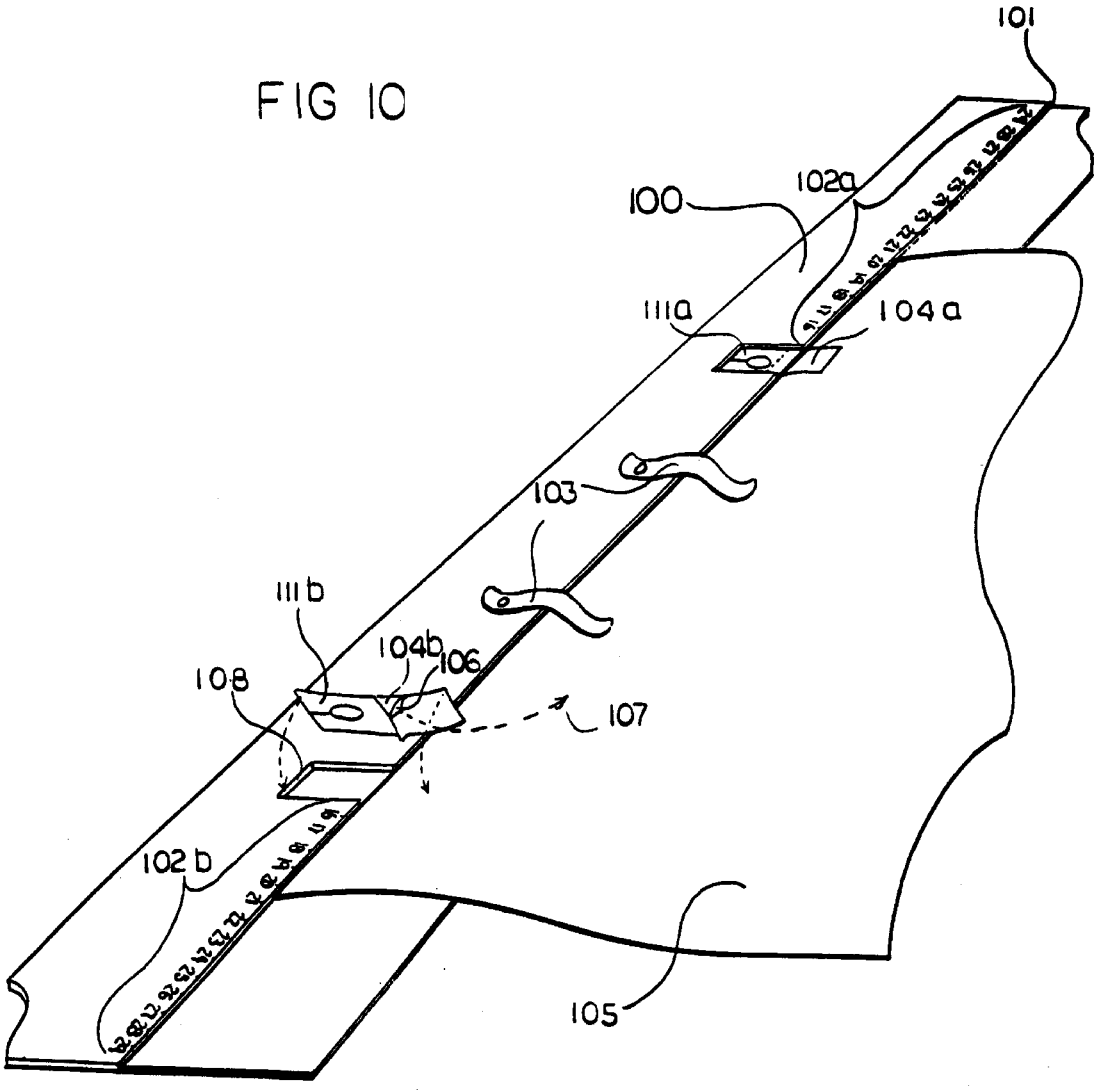

FIG. 10 is an illustration of a centering device for attaching tabs of the present invention to charts, posters, and the like.

DESCRIPTION OF THE PREFERRED EMBODIMENTS

Figure 1:
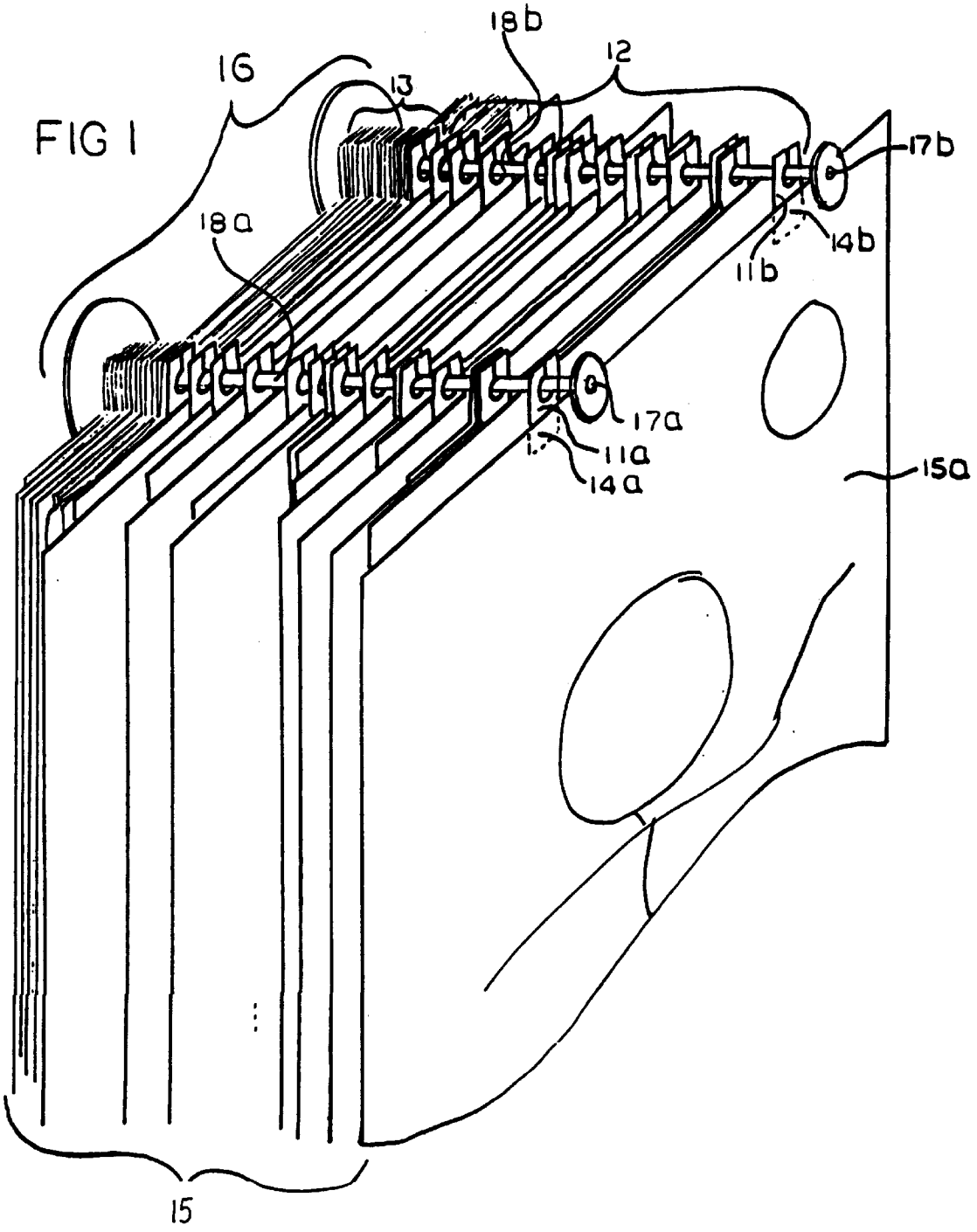
FIG. 1 is an illustration of posters hanging by precisely spaced tabs on a two rod rack.

FIG. 1 is an illustration of a plurality of posters 15 hanging on a two rod rack 16. In the preferred embodiment the rods 18*a* and 18*b* of rack 16 are spaced 14" apart, center to center. Wall mounts hold rods 19*a* and 19*b* and end stops 17*a* and 17 keep posters from sliding off. Tabs 11*a* and 11*b* are precisely spaced and centered on poster 15*a* to fit on the rods 18*a* and 18*b*. Most posters commonly used in the classroom measure at least 15" in one of their dimensions. And, for most posters, the maximum of the shorter side is 30". Spacing the tabs at 14" apart leaves a maximum of 7 ½" of poster top edge extending unsupported beyond the tabs on either side. Practically all posters are rigid enough so that the 7 ½" of unsupported extension will not sag. Those that would sag over time are generally kept straight by the adjacent posters, especially when bunched together as a group of posters 13. Tabs 11*a* and 11*b* of the preferred embodiment are 1" square and of 0.010" thick Mylar™ plastic. Transparent tape 14*a* and 14*b* is used to attach tabs 14*a* and 14*b* to a poster 15 and are generally about 0.0056" thick. Combined thickness of tape 14*a* and 14*b* and tabs 11*a* and lib is thus about 0.0156 or 1/64". Therefore more than 60 posters can be held bunched together 13 on one inch of rod length. Posters may be spread out for review as demonstrated with posters of group 12. Size and design of the rack is important relative to the situation of use: amount and placement of space available, the number of posters to be stored, etc. However this disclosure addresses only the tabs and the essential element of supporting rods.

Figure 2:
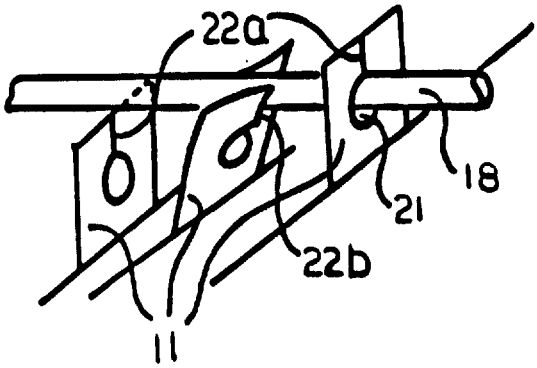
FIG. 2 is an illustration of the tab flexing open and snapping back into place onto the rod.

Attaching a poster with a tab of the present invention to a hanging rod is illustrated in FIG. 2. First and last tabs 11 have the slits 22*a* in normal closed position. The middle tab 11 is shown with an open slit 22*b* for moving the tab on or off rod 18. The rod's size may vary; in the preferred embodiment it is about ¼" and the hole 21 in the tab 11 is ⅜" allowing room for movement back and forth on the rod 18.

Figure 3:
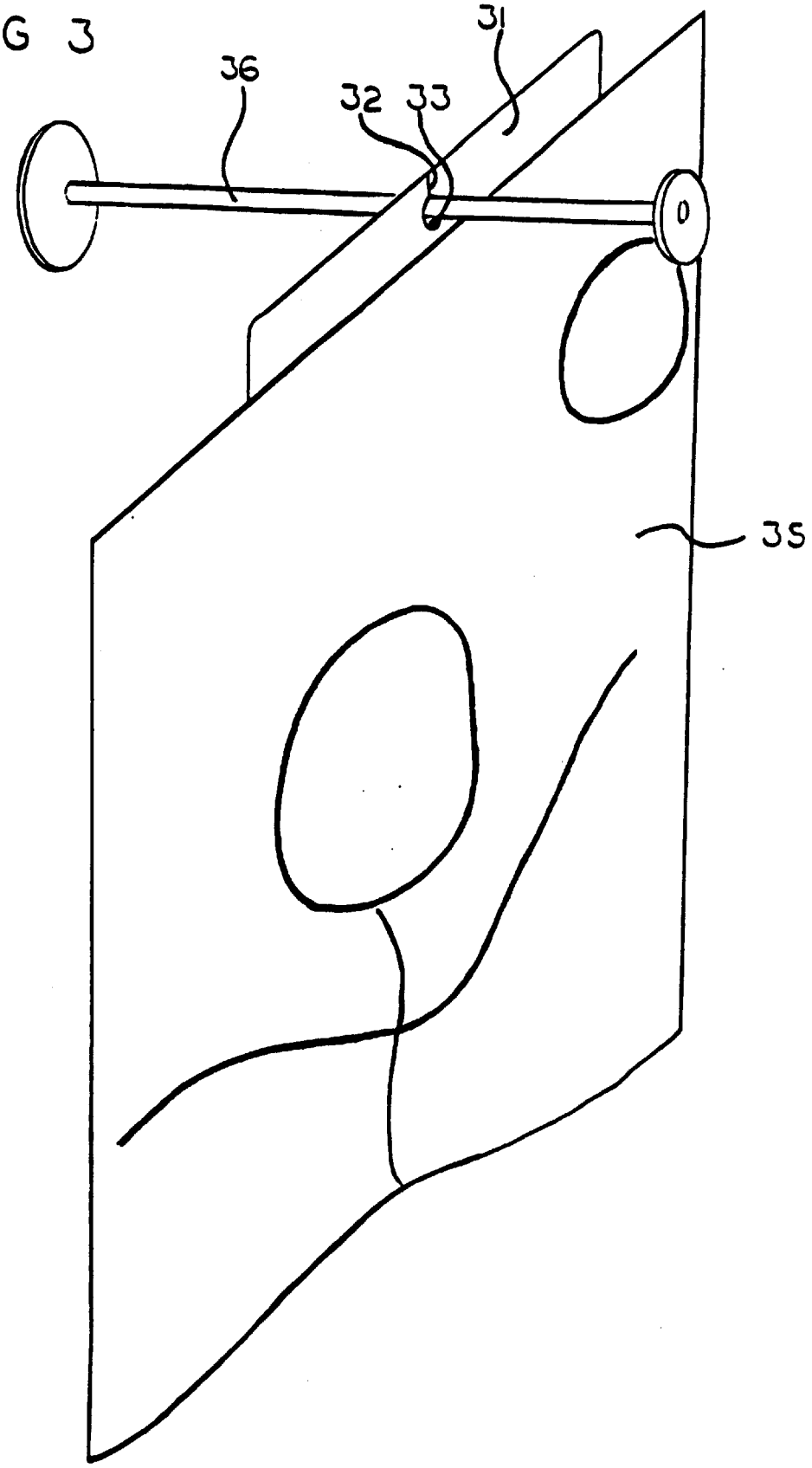
FIG. 3 is an illustration of a poster hanging by a long tab on a single rod rack.

FIG. 3 shows a poster 35 hanging on a single rod rack 36 by a long tab 31 with a single centered hole 33 and slit 32. A long tab 31 measures at least 15" long to accommodate the range of size and rigidity of posters as explained above for FIG. 1.

Figure 4:
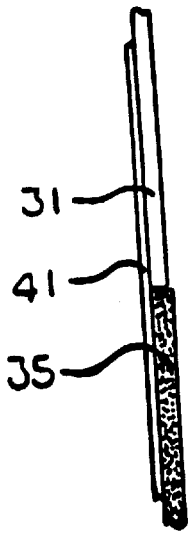
FIG. 4 is a side view of a tab being attached to a poster or chart.

FIG. 4 is a side view of a tab 31 which is attached to a poster 35 using an self-adhesive tap 41. It illustrates that tab 31 can be held within the thickness of poster 35, and that the extra thickness of tape 41 does not significantly decrease the capacity of a hanging rod or rods of a poster rack.

Figure 5:
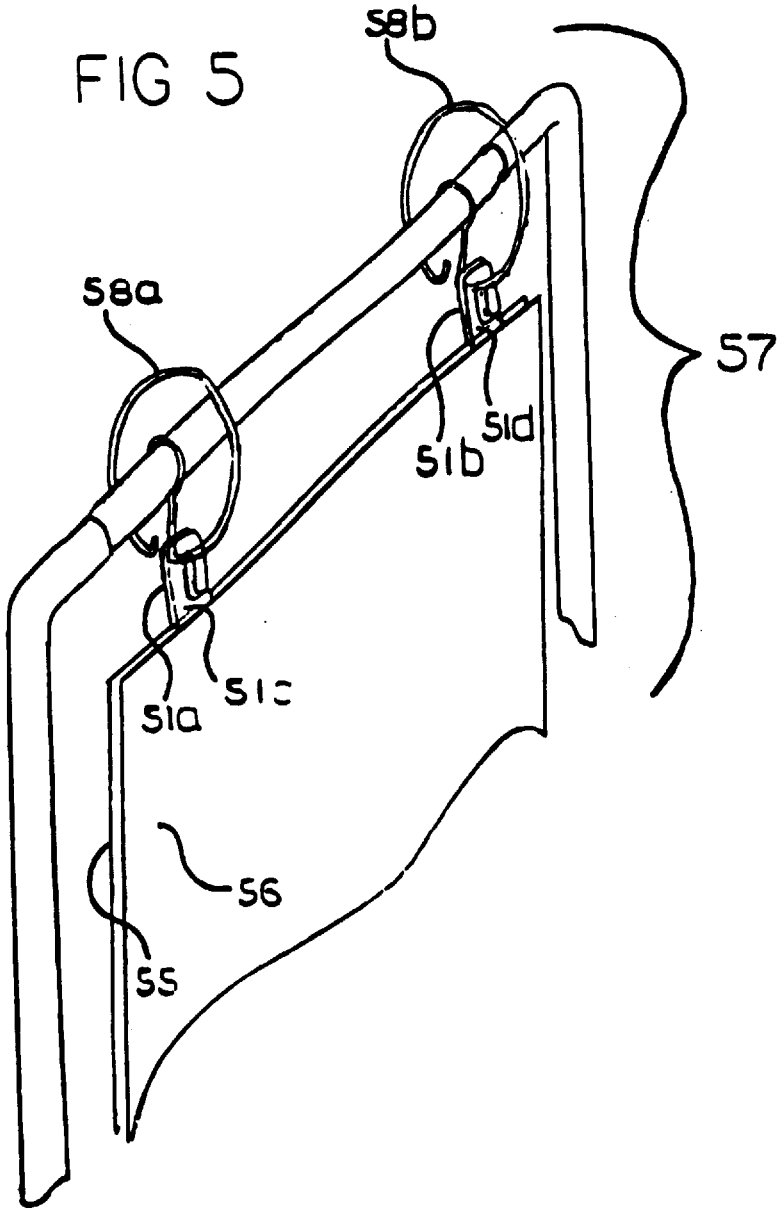
FIG. 5 is an illustration of the top portion a standard classroom rack for flip charts with two charts held by the flat plastic tabs of this invention hanging on the rings of the rack.

FIG. 5 is a view of the top portion a standard classroom rack 57 for flip charts. Two charts 55 and 56 held by flat plastic tabs 51*a* through 51*d* of this invention are hung on the rings 58*a* and 58*b* of rack 57. Chart 56 is in the front position, chart 55 is in the back position.

Figure 6:
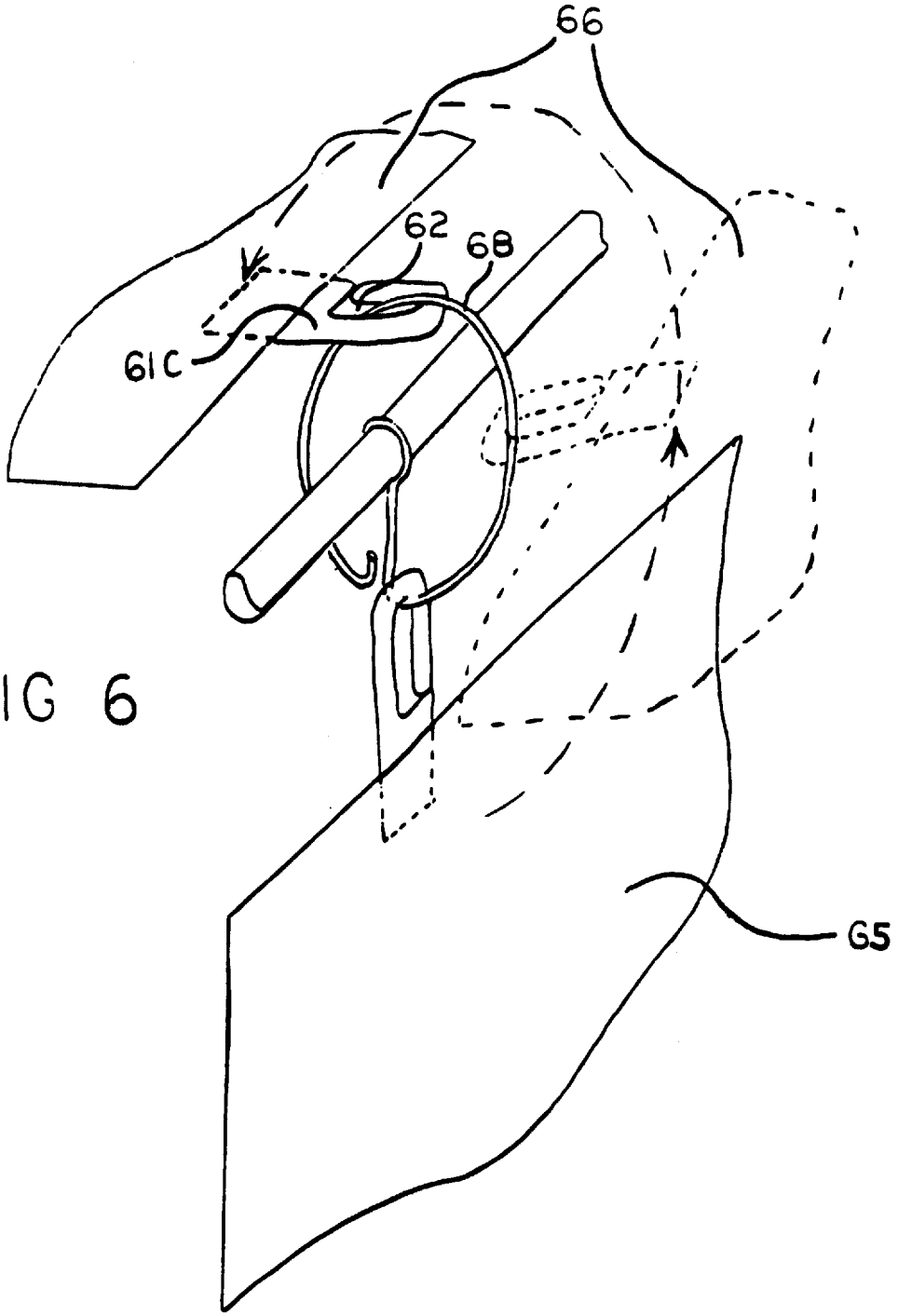
FIG. 6 is an illustration of the movement of the front chart held by a hook of this invention being flipped over the rack towards the back position.

FIG. 6 shows the movement of a front chart 66 held by hook 61*c* being flipped over the rack towards the back position. The elongated form of hole 62 provides room for movement along ring 68 avoiding binding friction even when hook 61*c* is angled tangentially in relationship to the ring 68.

Figure 7:
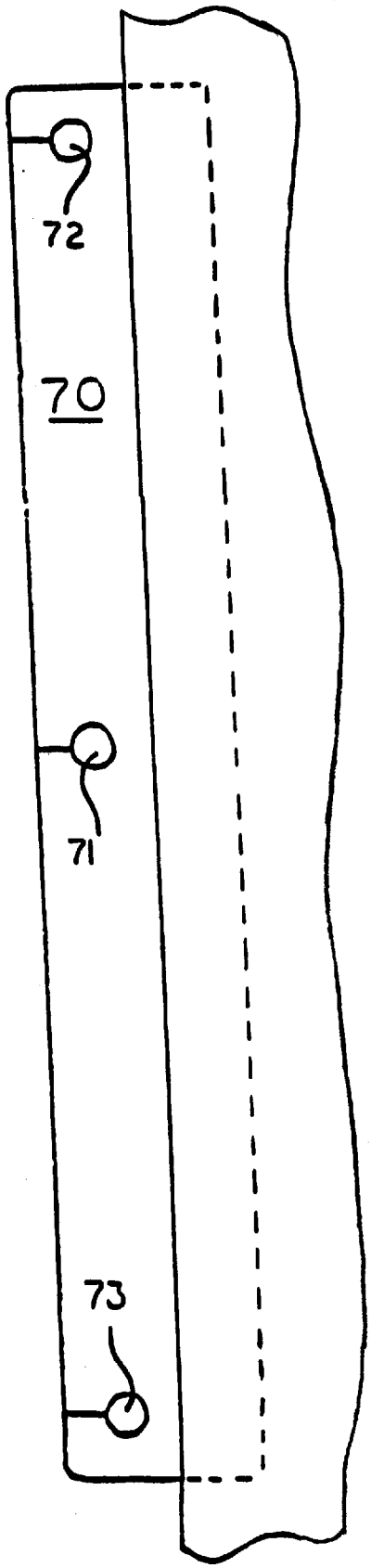
FIG. 7 is an illustration of a long tab with two alternative hole positions for use in combination with a single rod rack or a double rod rack.
Figure 8A:
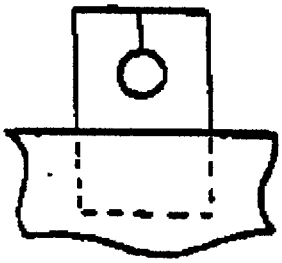
Figure 8B:
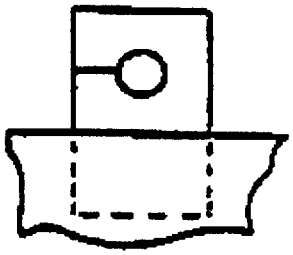
Figure 8C:
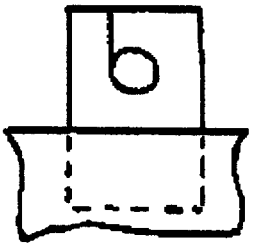
Figure 8D:
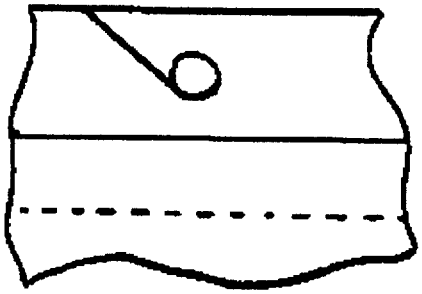
Figure 8E:
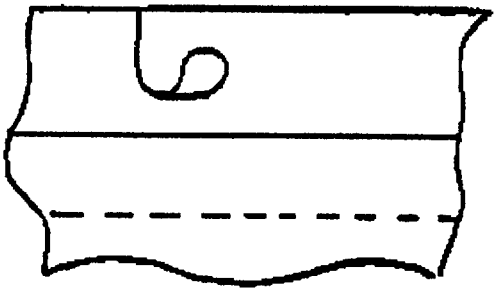

FIG. 7 shows a long tab 70 with two alternative hanging methods using three holes 71, 72, 73: one hole 7 in the center is a for single rod rack; two holes 71, 73 separated between their centers by 14" are provided for a double rod rack. The long tab 70 could be much longer to provide support for more flimsy materials such as thin paper or plastic bags.

FIGS. 8*a* through 8*e* are illustrations of alternative types of slits 81 through 85. Slits 82 through 85 could be more open slots, to the point of revealing a more traditional hook shape. Slit 81 could be a more open slot if it remains of lesser space than the supporting rod and to the extent that the material used were both flexible enough to allow the rod to pass, while rigid enough to provide support when hanging on the rod.

FIGS. 9*a* through 9*c* are illustrations of still other alternative types flip chart tabs 84 through 86 with slits 91 through 93 for flip charts 99*a* through 99*c*. The slot shape of the opening 97 is important to allow the tab to slide inclined tangentially to the ring as the chart is flipped over to the other side of the rack (as illustrated in FIG. 6). It was found that tab 95 is the most effective design allowing ease of placement and removal while still preventing accidental removal of the tab from a holding ring 58 (see FIG. 6).

FIG. 10 is an illustration of a centering device 100. A chart or poster 105 is shown face down, centered and held against alignment edge 101. Once poster 105 is centered, clips 103 hold the chart or poster 95 in position while tabs 111*a* and 111*b* are attached. One tab 111*a* has been attached by the simple addition of clear adhesive tape 104*a* attaching the tab 111*a* to the chart or poster 105. Another tab 111*b* with clear adhesive tape 104*b*, integrated during manufacture, is shown as the protective backing 107 is to be removed; tab 111*b* is to be positioned by placement to the guide notch 108 and the adhesive tape 104*b* applied to the back of the chart or poster 105.

A shown in FIGS. 1, 5 and 6 the objects to be hung for storage or for use as a flip chart can be hung on one or more rods or on rings. Rods and rings function as support hangers. The stile of the openings in the hanging tabs may be round for use on support rods, or may be elongated for use on either support rods or on support rings. In the later case, the elongated openings ease the flipping of the flip charts as disclosed with reference to FIG. 6.

What I claim is:

1. A storage arrangement for at least one sheetlike object, said at least one sheetlike object having a top edge and a first thickness, comprising a hanging rack having at least one rod;

support means for suspending said at least one sheetlike object from said hanging rack;

said support means includes at least one tab for suspending one of said at least one sheetlike object from said at least one rod, and an adhesive tape having a second thickness and;

said at least one sheetlike object maintaining its original two dimensional form while being suspended from said at least one rod, said tab having a third thickness less than double said first thickness of said at least one sheetlike object, and having a lower edge, a first area and a second area, said first area including an opening and a slit from a peripheral edge of said first area to said opening, said second area being provided on a first side of said at least one tab for attaching a first part of said adhesive tape, a second part of said adhesive tape being attached to a second side of said at least one sheetlike object butted with said top edge against said lower edge of said tab, thereby attaching said sheet-like object to said tab in a plane defined by said first side of said tab and said second side of said sheetlike object.

2. A hanging tab arrangement for a at least one sheetlike object in a hanging storage, said storage including at least one rod, comprising a tab having a lower edge and a thickness less than double the thickness of said at least one sheetlike object, and having a first area and a second area, said sheetlike object having a second side, and an upper edge butted against said lower edge of said tab;

said first area of said tab including an opening and a slit from a perimeter edge of said first area to said opening, said second area being provided on a first side of said tab for attaching a first part of a onesided adhesive tape, a second part of said onesided adhesive tape being attached to said second side of said sheetlike object;

thereby attaching said sheet-like object to said tab in a plane defined by said first side of said tab and said second side of said sheetlike object.

3. A hanging tab arrangement for a at least one sheetlike object, as claimed in claim 2, wherein said second area is attached to an upper edge of said sheetlike object and extends over a portion of the width of said at least one sheetlike object so that said at least one sheetlike object maintains its original two dimensional form while being suspended from said at least one rod.

4. A hanging tab arrangement for storing a sheetlike object in a hanging storage for sheetlike objects, said storage including two rods, comprising at least one tab having a lower edge and a thickness less than double the thickness of an attached one of said sheetlike objects, and having a first area and a second area, each of said sheetlike objects having an upper edge and being butted with said upper edge against said lower edge;

said first area including two symmetrically spaced openings, each of said openings including a slit to a peripheral edge of said first area, said second area being provided on a first side of said at least one tab for attaching a first part of an adhesive tape, a second part of said adhesive tape being attached to a second side of said sheetlike objects, thereby attaching said sheet-like object to said tab in a plane defined by said first side of said tab and said second side of said sheetlike object.

5. A hanging tab arrangement for hanging a sheetlike objects as claimed in claim 4, wherein said second area is attached to an upper edge of said sheetlike object and extends over a portion of the width of said sheetlike object so that said sheetlike object maintains its original two dimensional form while being stored in said hanging storage.

6. A hanging tab arrangement for a compact hanging storage for sheetlike objects, said storage having at least two rods for hanging said sheetlike objects, comprising a hanging tab including a lower edge for each particular sheetlike object, each of said sheetlike objects having an upper edge and being butted with said upper edge against said lower edge of said hanging tab;

said hanging tab further including a plurality of first areas and a second area, said first areas being spaced apart along an upper edge of said second area of said hanging tab and including each an opening and a slit from a peripheral edge of said first area to said opening;

said second area being provided on a first side of said hanging tab for attaching a first part of an adhesive tape, a second part of said adhesive tape being attached to a second side of one of said sheetlike objects, thereby attaching said one of said sheet-like objects to said tab in a plane defined by said first side of said hanging tab and said second side of said sheetlike object, whereby said attached sheetlike object maintains its original two dimensional form while hanging from said rods of said compact hanging storage.

7. A hanging tab arrangement for hanging a sheetlike object in a hanging storage, each of said sheetlike objects having an upper edge, said storage including at least one rod for hanging said sheetlike objects, comprising for each particular one of said sheetlike objects a tab having a thickness less than double the thickness of said particular one of said sheetlike objects, and having a first area, a second area and a lower edge next to said second area, said lower edge of said tab being aligned with and butted against said upper edge of said particular one of said sheetlike objects, an adhesive tape attached to said second area of said tab and one side of said particular one of said sheetlike objects thereby providing a common plane for said particular one of said sheetlike objects and said tab.

8. A hanging tab arrangement for a at least one sheetlike object in a hanging storage for sheetlike objects, said storage including at least one rod, said tab arrangement consisting of a tab, and an adhesive tape;

said tab having a lower edge, and having a first area and a second area, said sheetlike object having an upper edge, said upper edge being butted against said lower edge;

said first area of said tab including an opening and a slit from a peripheral edge of said first area to said opening, said second area being provided for attaching a first part of a onesided adhesive tape, a second part of said onesided adhesive tape being attached to one side of said sheetlike object;

thereby attaching said sheet-like object to said tab in a plane defined by said first side of said tab and said second side of said sheetlike object.

9. A hanging tab arrangement for storing a sheetlike object in a hanging storage for sheetlike objects, said storage including two rods, consisting of a tab, and an adhesive tape;

said tab having a lower edge, and having a first area and a second area, said sheetlike object having an upper edge, said sheetlike object being butted with said upper edge against said lower edge of said tab;

said first area including two symmetrically spaced openings, each of said openings including a slit to a peripheral edge of said first area, said second area being provided on a first side of said tab for attaching a first part of said adhesive tape, a second part of said adhesive tape being attached to a second side of said sheetlike object, thereby attaching said sheet-like object to said tab in a plane defined by said first side of said tab and said second side of said sheetlike object.

10. A hanging tab arrangement for a compact hanging storage for sheetlike objects, said storage having, at least two rods for hanging said sheetlike objects, consisting of a hanging tab for each particular sheetlike object, and an adhesive tape;

said hanging tab including a lower edge, a plurality of first areas and a second area, each of said sheetlike objects having an upper edge, said sheetlike object being butted with said upper edge against said lower edge of said hanging tab;

said first areas being spaced apart along an upper perimeter of said second area of said hanging tab and including each an opening, each of said openings including a slit to a peripheral edge of said first area;

said second area being provided on a first side of said hanging tab for attaching a first part of said adhesive tape, a second part of said adhesive tape being attached to a second side of one of said sheetlike objects, thereby attaching said one of said sheetlike objects to said tab in a plane defined by said first side of said hanging tab and said second side of said one of said sheetlike objects, whereby said attached sheetlike object maintains its original two dimensional form while hanging from said rods of said compact hanging storage.

* * * * *